US006090524A

United States Patent [19]

Deboer et al.

[11] Patent Number: 6,090,524

[45] Date of Patent: Jul. 18, 2000

[54] LITHOGRAPHIC PRINTING PLATES COMPRISING A PHOTOTHERMAL CONVERSION MATERIAL

[75] Inventors: Charles D. Deboer, Palmyra; Judith L. Fliessig, Rochester, both of N.Y.

[73] Assignee: Kodak Polychrome Graphics LLC, Norwalk, Conn.

[21] Appl. No.: 09/145,163

[22] Filed: Sep. 2, 1998

Related U.S. Application Data

[63] Continuation-in-part of application No. 08/949,699, Oct. 14, 1997, and a continuation-in-part of application No. 08/997,958, Dec. 24, 1997, which is a continuation-in-part of application No. 08/979,916, Mar. 13, 1997.

[51] Int. Cl.[7] ..... G03C 1/91

[52] U.S. Cl. ..... 430/272.1; 430/271.1; 430/273.1; 430/275.1; 430/276.1; 430/200; 430/201

[58] Field of Search ..... 430/271.1, 272.1, 430/273.1, 275.1, 276.1, 200, 201

[56] References Cited

U.S. PATENT DOCUMENTS

| | | | |
|---|---|---|---|
| 2,244,325 | 6/1941 | Bird | 252/313 |
| 2,574,902 | 11/1951 | Bechtold et al. | 252/313 |
| 2,597,872 | 5/1952 | Iler | 260/29.6 |
| 3,476,937 | 11/1969 | Vrancken | 250/65 |
| 3,832,948 | 9/1974 | Barker | 101/40.1 |
| 3,964,389 | 6/1976 | Peterson | 101/467 |
| 3,964,906 | 6/1976 | Kenney | 101/465 |
| 4,034,183 | 7/1977 | Uhlig | 219/122 |
| 4,054,094 | 10/1977 | Caddell et al. | 101/467 |
| 4,081,572 | 3/1978 | Pacansky | 427/53 |
| 4,470,797 | 9/1984 | Harry et al. | 425/534 |
| 4,695,286 | 9/1987 | Vanier et al. | 8/471 |
| 4,731,317 | 3/1988 | Fromson et al. | 430/159 |
| 4,775,657 | 10/1988 | Harrison et al. | 503/227 |
| 4,962,081 | 10/1990 | Harrison et al. | 503/227 |
| 4,973,572 | 11/1990 | DeBoer | 503/227 |
| 5,278,023 | 1/1994 | Bills et al. | 430/201 |
| 5,354,633 | 10/1994 | Lewis et al. | 430/5 |
| 5,372,907 | 12/1994 | Haley et al. | 430/157 |
| 5,446,477 | 8/1995 | Baek et al. | 346/138 |
| 5,451,485 | 9/1995 | Kaszczuk et al. | 430/201 |
| 5,458,591 | 10/1995 | Roessler et al. | 604/364 |
| 5,460,918 | 10/1995 | Ali et al. | 430/200 |
| 5,491,046 | 2/1996 | DeBoer et al. | 430/302 |
| 5,569,573 | 10/1996 | Takahashi et al. | 430/138 |
| 5,574,493 | 11/1996 | Sanger et al. | 347/262 |
| 5,639,586 | 6/1997 | Hauquier et al. | 430/159 |
| 5,695,907 | 12/1997 | Chang | 430/201 |
| 5,725,989 | 3/1998 | Chang et al. | 430/201 |
| 5,816,162 | 10/1998 | Vermeersch | 101/467 |

FOREIGN PATENT DOCUMENTS

| | | |
|---|---|---|
| 0562952A1 | 3/1993 | European Pat. Off. . |
| 0573091A1 | 12/1993 | European Pat. Off. . |
| 0573092A1 | 12/1993 | European Pat. Off. . |
| 0683728B1 | 11/1995 | European Pat. Off. . |
| 4442235 | 6/1995 | Germany . |
| 105560 | 8/1980 | Japan . |
| 55/105560 | 8/1980 | Japan . |
| 92/09934 | 6/1992 | WIPO . |
| 94/18005 | 8/1994 | WIPO . |

OTHER PUBLICATIONS

Research Disclosure, Jan. 1992, #33303, "A lithographic Printing Plate" by Vermeersch of Agfa–Gevaert, NV.

*Primary Examiner*—Christopher G. Young
*Attorney, Agent, or Firm*—Ratner & Prestia

[57] ABSTRACT

An improved lithographic printing plate made by coating a support web with a coextensive ink receptive photothermal conversion layer and then overcoating with a ink repellent layer comprising a crosslinked polymeric matrix containing a colloid of an oxide or a hydroxide of a metal selected from the group consisting of beryllium, magnesium, aluminum, silicon, gadolinium, germanium, arsenic, indium, tin, antimony, tellurium, lead, bismuth, a transition metal and combinations thereof, along with a photothermal conversion material.

32 Claims, No Drawings

LITHOGRAPHIC PRINTING PLATES COMPRISING A PHOTOTHERMAL CONVERSION MATERIAL

RELATED APPLICATIONS

This application is a continuation-in-part of U.S. Ser. No. 08/949,699 filed Oct. 14, 1997, by DeBoer; and also is a continuation-in-part of U.S. Ser. No. 08/997,958 filed Dec. 24, 1997, which is a continuation-in-part of U.S. Ser. No. 08/979,916 filed Mar. 13, 1997, by DeBoer and Fleissig. Reference is made to commonly assigned U.S. patent applications Ser. No. 08/816,287, filed Mar. 13, 1997, entitled "METHOD OF IMAGING LITHOGRAPHIC PRINTING PLATES WITH HIGH INTENSITY LASER" the disclosure of which is incorporated herein by reference.

FIELD OF THE INVENTION

This invention relates in general to lithographic printing plates and particularly to lithographic printing plates which do not require wet processing.

BACKGROUND OF THE INVENTION

The art of lithographic printing is based upon the immiscibility of oil and water, wherein the oily material or ink is preferentially retained by the image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced; such as paper, cloth and the like. Commonly the ink is transferred to an intermediate material called the blanket which in turn transfers the ink to the surface of the material upon which the image is to be reproduced.

A very widely used type of lithographic printing plate has a light-sensitive coating applied to an aluminum base support. The coating may respond to light by having the portion which is exposed become soluble so that it is removed in the developing process. Such a plate is referred to as positive-working. Conversely, when that portion of the coating which is exposed becomes hardened, the plate is referred to as negative-working. In both instances the image area remaining is ink-receptive or oleophilic and the non-image area or background is water-receptive or hydrophilic. The differentiation between image and non-image areas is made in the exposure process where a film is applied to the plate with a vacuum to insure good contact. The plate is then exposed to a light source, a portion of which is composed of UV radiation. In the instance where a positive plate is used, the area on the film that corresponds to the image on the plate is opaque so that no light will strike the plate, whereas the area on the film that corresponds to the non-image area is clear and permits the transmission of light to the coating which then becomes more soluble and is removed. In the case of a negative plate the converse is true. The area on the film corresponding to the image area is clear while the non-image area is opaque. The coating under the clear area of film is hardened by the action of light while the area not struck by light is removed. The light-hardened surface of a negative plate is therefore oleophilic and will accept ink while the non-image area which has had the coating removed through the action of a developer is desensitized and is therefore hydrophilic.

Direct write photothermal litho plates are known such as the Kodak Direct Image Thermal Printing Plate. However, they require wet processing in alkaline solutions. It would be desirable to have a direct write photothermal litho plate that did not require any processing.

The prior art has tried to produce such plates by a variety of means. All of them fall short of a plate that has high writing sensitivity, high image quality, short roll up, and long run length without any processing.

U.S. Pat. No. 5,372,907 describes a direct write litho plate which is exposed to the laser beam, then heated to crosslink and thereby prevent the development of the exposed areas and to simultaneously render the unexposed areas more developable, and the plate is then developed in conventional alkaline plate developer solution. The problem with this is that developer solutions and the equipment that contains them require maintenance, cleaning, and periodic developer replenishment, all of which are costly and cumbersome.

U.S. Pat. No. 4,034,183 describes a direct write litho plate without development whereby a laser absorbing hydrophilic top layer coated on a support is exposed to a laser beam to burn the absorber to convert it from an ink repelling to an ink receiving state. All of the examples and teachings require a high power laser, and the run lengths of the resulting litho plates are limited.

U.S. Pat. No. 3,832,948 describes both a printing plate with a hydrophilic layer that may be ablated by strong light from a hydrophobic support and also a printing plate with a hydrophobic layer that may be ablated from a hydrophilic support. However, no examples are given.

U.S. Pat. No. 3,964,389 describes a no process printing plate made by laser transfer of material from a carrier film (donor) to a lithographic surface. The problem of this method is that small particles of dust trapped between the two layers may cause image degradation. Also, two sheets to prepare is more expensive.

U.S. Pat. No. 4,054,094 describes a process for making a litho plate by using a laser beam to etch away a thin top coating of polysilicic acid on a polyester base, thereby rendering the exposed areas receptive to ink. No details of run length or print quality are giving, but it is expected that an un-crosslinked polymer such as polysilicic acid will wear off relatively rapidly and give a short run length of acceptable prints.

U.S. Pat. No. 4,081,572 describes a method for preparing a printing master on a substrate by coating the substrate with a hydrophilic polyamic acid and then imagewise converting the polyamic acid to melanophilic polyimide with heat from a flash lamp or a laser. No details of run length, image quality or ink/water balance are given.

U.S. Pat. No. 4,731,317 describes a method for making a litho plate by coating a polymeric diazo resin on a grained anodized aluminum litho support, exposing the image areas with a YAG laser, and then processing the plate with a graphic arts lacquer. The lacquering step is inconvenient and expensive.

Japanese Kokai No. 55/105560 describes a method of preparation of a litho plate by laser beam removal of a hydrophilic layer coated on a melanophilic support, in which a hydrophilic layer contains colloidal silica, colloidal alumina, a carboxylic acid, or a salt of a carboxylic acid. The only examples given use colloidal alumina alone, or zinc acetate alone, with no crosslinkers or addenda. No details are given for the ink/water balance or limiting run length.

WO 92/09934 describes and broadly claims any photosensitive composition containing a photoacid generator, and a polymer with acid labile tetrahydropyranyl groups. This would include a hydrophobic/hydrophilic switching lithographic plate composition. However, such a polymeric switch is known to give weak discrimination between ink and water in the printing process.

EP 0 562 952 A1 describes a printing plate having a polymeric azide coated on a lithographic support, and removal of the polymeric azide by exposure to a laser beam. No printing press examples are given.

U.S. Pat. No. 5,460,918 describes a thermal transfer process for preparing a litho plate from a donor with an oxazoline polymer to a silicate surface receiver. A two sheet system such as this is subject to image quality problems from dust and the expense of preparing two sheets.

It would be desirable to be able to prepare a litho plate that has high writing sensitivity, high image quality, short roll up, and long run length without any processing. None of the prior art examples can do this satisfactorily.

SUMMARY OF THE INVENTION

The present invention is a lithographic printing plate element in which a support web is coated with an ink accepting laser absorbing layer which is subsequently overcoated with a crosslinked hydrophilic layer having metal oxide groups on the surface. Exposure of this plate to a high intensity laser beam followed by mounting on a press results in excellent impressions without chemical processing The lithographic printing plate precursor element comprises:

a) a support web;

b) a coextensive ink receptive (melanophilic) photothermal conversion layer; and, c) a coextensive ink repellent (melanophobic) layer comprising:

(i) a crosslinked polymeric matrix containing a colloid of an oxide or a hydroxide of a metal selected from the group consisting of beryllium, magnesium, aluminum, silicon, gadolinium, germanium, arsenic, indium, tin, antimony, tellurium, lead, bismuth, a transition metal and combinations thereof; and, (ii) a photothermal conversion material.

An added embodiment of this invention is a method of making a lithographic printing plate comprising:

I) providing an element comprising:

a) a support web;

b) a coextensive ink receptive photothermal conversion layer; and, c) a coextensive ink repellent layer comprising:

(i) a crosslinked polymeric matrix containing a colloid of an oxide or a hydroxide of a metal selected from the group consisting of beryllium, magnesium, aluminum, silicon, gadolinium, germanium, arsenic, indium, tin, antimony, tellurium, lead, bismuth, a transition metal and combinations thereof; and, (ii) a photothermal conversion material; and, II) exposing the element to a laser beam having an intensity greater than 0.1 mW/$\mu^2$ for a time sufficient to give a total exposure of 200 mJ/cm$^2$ or greater to form an exposed lithographic printing plate. A further advantage of this embodiment is that after exposing the element to the laser beam, the exposed lithographic printing plate is directly mounted on a lithographic printing press.

DETAILED DESCRIPTION OF THE INVENTION

Parent U.S. patent applications Ser. No. 08/979,916 filed Mar. 13, 1997 and Ser. No. 08/997,958 filed Dec. 24, 1997, the disclosure of each is incorporated herein by reference, describe a lithographic printing plate in which a support web is coated with an ink accepting laser absorbing layer which is subsequently overcoated with a crosslinked hydrophilic layer having metal oxide groups on the surface. Exposure of this plate to a high intensity laser beam followed by mounting on a press results in excellent impressions without chemical processing. By the addition of a photothermal conversion material to the top hydrophilic layer, the high writing sensitivity which is about 300 mJ/cm$^2$ is further enhanced. Thus the lithographic printing plate of this invention has high writing sensitivity, high image quality, short roll up, and long run length without any processing.

The lithographic printing plate of this invention has as the three essential components: a support web having coated thereon a bottom coextensive melanophilic photothermal conversion layer, and a top coextensive melanophobic layer. The top coextensive melanophobic layer is composed of a crosslinked polymeric matrix containing a colloid of an oxide or a hydroxide of a metal selected from the group consisting of beryllium, magnesium, aluminum, silicon, gadolinium, germanium, arsenic, indium, tin, antimony, tellurium, lead, bismuth, a transition metal and combinations thereof; and, a photothermal conversion material.

As used herein, the term "melanophilic" is Greek for ink-loving, i.e., "ink receptive", and the term melanophobic is Greek for ink-fearing, i.e., "ink repellent". Since most conventional printing inks are linseed oil based and are used with an aqueous fountain solution in conventional lithographic printing, melanophilic will usually coincide with "oleophilic" and melanophobic will usually coincide with "hydrophilic".

Support Web

The support web for this invention can be a polymer, metal or paper foil, or a lamination of any of the three. The term "support web" as used herein is intended to mean any substrate, sheet, film or plate material having a composition and physical dimensions commonly used as substrates in lithography. The thickness of the support web (hereinafter identified as "support") can be varied, as long as it is sufficient to sustain the wear of the printing press and thin enough to wrap around the printing form. A preferred embodiment uses a polyester film, such as a polyethylene terephthalate film in a thickness from 100 to 200 microns as the support web. In another preferred embodiment, the support web is an aluminum sheet from 100 to 500 microns in thickness; and more preferably is an anodized aluminum sheet and particularly a grained anodized aluminum sheet. The support should resist stretching so the color records will register in a full color image. The support may be coated with one or more "subbing" layers to improve adhesion of the final assemblage. The back side of the support may be coated with antistat agents and/or slipping layers or matte layers to improve handling and "feel" of the resulting litho plate.

Bottom Photothermal Conversion Layer

The bottom coextensive photothermal conversion layer is melanophilic, i.e., ink receptive, and contains a photothermal conversion material and typically a melanophilic binder material.

The photothermal conversion material (also referred to herein as an Absorber) absorbs laser radiation and converts it to heat. It converts photons into heat phonons. To do this it must contain a non-luminescent absorber. Such an absorber may be a dye, a pigment, a metal, or a dichroic stack of materials that absorb by virtue of their refractive index and thickness. In addition to heating the layer, the absorber should have the property of being melanophilic after exposure to the laser. Since most conventional printing inks are linseed oil based, melanophilic will usually coincide with oleophilic. A useful form of particulate radiation absorbers containing a mixture of absorbing dye and melanophilic binder can be made the evaporative limited coalescence process as described in U.S. Pat. No. 5,234,890, hereby incorporated by reference. Examples of dyes useful as absorbers for near infrared diode laser beams may be found in U.S. Pat. No. 4,973,572, hereby incorporated by reference. Preferred infrared (IR) absorbing dyes for use in this invention are 2-{2-{2-Chloro-3-{(1,3-dihydro-1,1,3-trimethyl-2H-benz {e}indol-2-ylidene)ethylidene}-1-cyclohexen-1-yl}-ethenyl}-1,1,3-trimethyl-1H-benz {e}indolium salt of 4-methylbenzenesufonate; and 2-{2-{2-chloro-3-{(1,3-dihydro-1,1-dimethyl-3-sulfonatopropyl-2H-benz{e}indol-2-ylidene)ethylidene}-1-cylcohexen-1-yl}ethenyl}-1,1-dimethyl-3-sulfonatopropyl-1H-benz {e}indolium sodium salt. In a preferred embodiment of the invention the absorber is a pigment. In a more preferred embodiment of the invention the pigment is carbon, particularly sulfonic acid surface modified submicron carbon particles. The size of the particles should not be more than the thickness of the layer. Preferably, the size of the particles will be half the thickness of the layer or less, from about 0.1 micron to about 0.5 micron.

If a binder is used to hold a dye or pigment in the photothermal conversion layer, it may be chosen from a large list of film forming polymers. Useful polymers may be found in the families of polycarbonates, polyesters, polyvinylbutyrals, and polyacrylates. Chemically modified cellulose derivatives are particularly useful, such as nitrocellulose, cellulose acetate propionate, and cellulose acetate. Exemplary polymers may be found in U.S. Pat. Nos. 4,695,286; 4,470,797; 4,775,657; and 4,962,081, hereby incorporated by reference. Preferred photothermal conversion layers of this type includes layers comprising carbon dispersed in a cellulosic binder, and particularly layers comprising carbon dispersed in nitrocelulose. A particularly advantageous polymer for dispersing carbon is a polyvinylbutyral such as Butvar B76 poly(vinylbutyral-covinylalcohol-co-vinylacetate) (80%,18%,2%) from Monsanto.

Alternatively, the coextensive ink receptive photothermal conversion layer may be a thin film of a metal material deposited directly on the support web to form the absorber layer. In a preferred embodiment of this invention, the photothermal conversion layer comprises an evaporated layer of titanium typically having an optical density of about 0.40 or greater.

Top Melanophobic Layer

The top coextensive melanophobic, i.e., ink repellent or hydrophilic, layer is composed of a crosslinked polymeric matrix containing a colloid of an oxide or a hydroxide of beryllium, magnesium, aluminum, silicon, gadolinium, germanium, arsenic, indium, tin, antimony, tellurium, lead, bismuth, a transition metal or combinations thereof, as well as a photothermal conversion material.

In the unexposed areas, the hydrophilic layer is intended to be wet effectively by the aqueous fountain solution in the lithographic printing process, and when wet, to repel the ink. In addition, it is useful if the hydrophilic layer is somewhat porous, so that wetting is even more effective. The hydrophilic layer must be crosslinked if long printing run lengths are to be achieved, because an un-crosslinked layer will wear away too quickly. The ink repellent or hydrophilic layer is a sol-gel layer which is a crosslinked polymeric matrix containing a colloid of an oxide or a hydroxide of a metal selected from the group consisting of beryllium, magnesium, aluminum, silicon, gadolinium, germanium, arsenic, indium, tin, antimony, tellurium, lead, bismuth, a transition metal, and combinations thereof. Many such crosslinked hydrophilic layers are available. Those derived from di, tri, or tetra alkoxy silanes or titanates, zirconates and aluminates are particularly useful in this invention. Examples are colloids of hydroxysilicon, hydroxyaluminum, hydroxytitanium and hydroxyzirconium. Those colloids are formed by methods fully described in U.S. Pat. Nos. 2,244,325; 2,574,902; and 2,597,872. Stable dispersions of such colloids can be conveniently purchased from companies such as the DuPont Company of Wilmington, Del. It is important that the hydrophilic layer have a strong affinity for water. If the hydrophilic layer does not hold enough water, the background areas may carry some ink, commonly referred to as "scumming" of the lithographic plate. To compensate for this problem, the press operator may have to increase the amount of fountain solution fed to the printing form, and this, in turn, may lead to emulsification of the ink with the fountain solution, resulting in a mottled appearance in solid dark areas. The severity of the problem will depend on the actual ink and fountain solution as well as the press that is being used, but, in general, the more affinity the background of the plate has for water, the less printing problems will be. In this invention, it has been found that an overcoat of metal colloids crosslinked with a crosslinker containing ionic groups helps to hold water and improves the printing performance. In a preferred embodiment of the invention the metal colloid is colloidal silica and the crosslinker is N-trimethoxysilylpropyl-N,N,N-trimethyl ammonium chloride. For the same reason, the hydrophilic layer is most effective when it contains a minimum amount of hydrophobic groups such as methyl or alkyl groups. The thickness of the crosslinking and polymer forming layer may be from 0.05 to 1 $\mu$m in thickness, and most preferably from 0.1 to 0.3 $\mu$m in thickness. The amount of silica added to the layer may be from 100 to 5000% of the crosslinking agent, and most preferably from 500% to 1500% of the crosslinking agent. Surfactants, dyes, colorants useful in visualizing the written image, and other addenda may be added to the hydrophilic layer, as long as their level is low enough that there is no significant interference with the ability of the layer to hold water and repel ink. Preferably, the ink repellent layer contains less than 5% hydrocarbon groups by weight. Descriptions of preferred embodiments of the hydrophilic layer are given in cross referenced U.S. patent application Ser. No. 08/997,958, filed Dec. 24, 1997 entitled, "LITHOGRAPHIC PRINTING PLATES WITH A SOL-GEL LAYER". Such preferred hydrophilic layers include layers prepared from Nalco 2326, 5 nm ammonia stabilized, colloidal silica, (from the Nalco Corporation, Naperville, Ill.); tetrabutyltitanate; a mixture of colloidal alumina (Dispal 18N4-20) with hydrolyzed tetraethylorthosilicate; a mixture of tetraethylorthosilicate with hydrochloric acid; zirconium butoxide; and the like. Preferred a hardeners used in these hydrophilic layers include: 3-aminopropyltriethoxysilane; a mixture of dimethyl dimethoxysilane and methyl trimethoxysilane sold as Z-6070 by the Dow Corning Company; glycidoxypropyltrimethoxysilane; and the like.

The photothermal conversion material used in the top hydrophilic layer may be any of the photothermal conversion materials described for use in the bottom ink receptive layer. While different materials may be used in each layer, typically the same photothermal conversion material is used in both layers. In a preferred embodiment of the invention the photothermal conversion material is a pigment. In a more preferred embodiment of the invention the pigment is carbon, particularly sulfonic acid surface modified submicron carbon particles. In another preferred embodiment, the photothermal conversion material is an infrared (IR) absorbing dye. A particularly preferred the IR dye for use in this invention is 2-{2-{2-chloro-3-{(1,3-dihydro-1,1-dimethyl-3-sulfonatopropyl-2H-benz {e}indol-2-ylidene) ethylidene}-1-cylcohexen-1-yl}ethenyl}-1,1-dimethyl-3-sulfonatopropyl-1H-benz {e}indolium sodium salt; or 2-{2-{2-Chloro-3-{(1,3-dihydro-1,1,3-trimethyl-2H-benz {e}indol-2-ylidene)ethylidene}-1-cyclohexen-1-yl}-ethenyl}-1,1,3-trimethyl-1H-benz {e}indolium salt of 4-methylbenzenesufonate.

Typically the layers of the element of this invention are coated on the support, or previously coated intermediate layers, by any of the commonly known coating methods such as spin coating, knife coating, gravure coating, dip coating, or extrusion hopper coating. Surfactants may be included in the coated layers to facilitate coating uniformity. A particularly useful surfactant for coated polymer layers is Zonyl FSN, a surfactant manufactured by the DuPont company of Wilmington, Del.

Method of Use

The process for using the resulting lithographic plate comprises the steps of 1) exposing the plate to a focused laser beam in the areas where ink is desired in the printing image, and 2) employing the plate on a conventional lithographic printing press. No heating, process, or cleaning is needed before the printing operation. A vacuum cleaning dust collector may be useful during the laser exposure step to keep the focusing lens clean. Such a collector is fully described in U.S. Pat. No. 5,574,493.

The laser used to expose the lithoplate of this invention is preferably a diode laser, because of the reliability and low maintenance of diode laser systems, but other lasers such as gas or solid state lasers may also be used. In the method for making the lithographic printing plate described above, it has been found that by exposing these elements to a focused laser beam having an intensity greater than 0.1 mW/$\mu^2$ for a time sufficient to give a total exposure of about 200 milliJoules/cm$^2$ or greater, the efficiency of the operation improves and better printing steps are achieved with lower laser exposure energy. Good printing steps are defined as those having a uniform reflection optical density greater than 1.0. This improvement in efficiency is unexpected because it has generally been found in exposure of lithographic printing plates from a film negative that the same exposure level is required, that is, the same amount ofjoules per square centimeter, regardless of the intensity of the exposure lamp. In a typical mode of operation, the printing plate of this invention is exposed to a focused diode laser beam emitting in the infrared spectral region, such as at a wavelength of 830 nm, on an apparatus similar to that described in U.S. Pat. No. 5,446,477, with exposure levels of about 600 mJ/cm$^2$, and intensities of the beam of about 3 mW/$\mu^2$. In this mode of operation the laser beam typically is modulated to produce a halftone dot image. After imaging exposure, the imaged plate of this invention is directly mounted on a conventional lithographic printing press, such as an A.B. Dick press, without any intermediate processing steps, and the conventional printing process is initiated.

The improvement claimed in this invention lies in the addition of a photothermal conversion material to the topmost hydrophilic layer of the printing plate, which improves the writing speed of the plate. The reason this is important is that laser thermal processes typically require about a million times more exposure than silver halide films. While high powered lasers are becoming more available, most laser thermal writing devices are power limited, and the throughput, or writing speed, is determined by exposure requirements of the media being written. Therefore, an improvement in writing speed, or decrease in required exposure energy, results in improved throughput, less waiting time, and more efficient utilization of the equipment. As the examples show, the addition of an absorber in the top layer improves the writing speed of the printing plate.

The printing plates of this invention and their use are illustrated by the following examples but are not intended to be limited thereby.

EXAMPLE 1

An evaporated layer of titanium (optical density=0.41) on a 102 micron thick polyethylene terephthalate film support was overcoated with a solution of 1% silica (Nalco 2326, 5 nm colloidal silica, ammonia stabilized, from the Nalco Corporation, Naperville, Ill.), 0.5% carbon (Cabojet 300, a 15% water dispersion of carbon from the Cabot Corporation, Bellerica, Mass.), 0.1% Zonyl FSN surfactant (DuPont Corporation, Wilmington, Del.) and 0.1% 3-aminopropyltriethoxysilane, added by drops with stirring, all in water. This solution was coated using a one mil knife, dried and then baked at 100° C. for 1 hour to produce the experimental printing plate. The resulting dried lithographic plate was then exposed to a focused diode laser beam at 830 nm wavelength on an apparatus similar to that described in U.S. Pat. No. 5,446,477. The exposure level was about 600 mJ/square cm, and the intensity of the beam was about 3 mW/square micron. The laser beam was modulated to produce a stepwedge pattern, where each step had 6/256 less power than the previous step. After exposure the plate was mounted on an ABDick press and several hundred impressions were made. The required exposure was defined by the last solid ink density step that was printed. In this example 24 steps were printed when the plate was exposed at 400 rpm.

EXAMPLE 2

In this example a plate was prepared as in example 1, but the carbon in the overcoat was replaced with 0.2% 2-{2-{2-chloro-3-{(1,3-dihydro-1,1-dimethyl-3-sulfonatopropyl-2H-benz {e}indol-2-ylidene)ethylidene}-1-cylcohexen-1-yl}ethenyl}-1,1-dimethyl-3-sulfonatopropyl-1H-benz {e}indolium sodium salt. In this case, 29 steps were printed when the plate was exposed at 400 rpm.

Control 1

In this case a plate was prepared as in example 1, but no absorber was added to the overcoat. In this case, only 22 steps were printed when the plate was exposed at 400 rpm.

EXAMPLE 3

A suspension of 4% carbon (Black Pearls 700 from the Cabot Corporation of Bellerica, Mass.) and 2% Butvar B76 (Monsanto Corp., St. Louis, Mo.) in methyl isobutyl ketone was coated with a 2 mil knife onto 102 micron thick polyethylene terephthalate film support. This was overcoated with the sample overcoat used in Example 1, and exposed in the same way. The printed impressions showed 18 solid steps when exposed at 600 rpm.

EXAMPLE 4

In this example a plate was prepared as in example 3, but the carbon in the overcoat was replaced with 0.2% 2-{2-{2-chloro-3-{(1,3-dihydro-1,1-dimethyl-3-sulfonatopropyl-2H-benz {e}indol-2-ylidene)ethylidene}-1-cylcohexen-1-yl}ethenyl}-1,1-dimethyl-3-sulfonatopropyl-1H-benz {e}indolium sodium salt. In this case, 25 steps were printed when the plate was exposed at 600 rpm.

Control 2

In this case a plate was prepared as in example 3, but no absorber was added to the overcoat. In this case, only 17 steps were printed when the plate was exposed at 600 rpm.

EXAMPLE 5

A grained anodized aluminum support was coated at 25 ml per square meter with a mixture of 24 g Cabot Black Pearls 700 carbon, 24 g nitrocellulose (from Herculese Corporation—70% nitrocellulose moistened with 30% propanol has a viscosity of 1000–1500 cps), and 1600 ml of methylisobutyl ketone. (Prior to coating , the mixture was tumbled with 1.8 mm zirconia beads for several days to disperse the carbon.) After drying, the coated support was overcoated at 20 ml per square meter with a mixture of 70 ml water, 30 g Nalco 2326 colloidal silica, 0.05 g of nonyl-phenoxypolyglycidol, 0.5 g 3-aminopropyltriethoxysilane, and 1 g of Cabojet 200 carbon dispersion (sulfonic acid surface modified submicron carbon dispersed in water from the Cabot Corporation, Bellerica, Mass.). The coating was dried at 118° C. for three minutes. The resulting dried lithographic plate was then exposed to a focused diode laser beam as described in example 1. After exposure the plate was directly mounted on an ABDick lithographic printing press and several thousand excellent impressions were made.

The invention has been described in detail, with particular reference to certain preferred embodiments thereof, but it should be understood that variations and modifications can be effected with the spirit and scope of the invention.

What is claimed is:

1. A lithographic printing plate precursor element comprising:

a) a support web;

b) a coextensive ink receptive photothermal conversion layer; and, c) a coextensive ink repellent layer comprising:

(i) a crosslinked polymeric matrix containing a colloid of an oxide or a hydroxide of a metal selected from the group consisting of beryllium, magnesium, aluminum, silicon, gadolinium, germanium, arsenic, indium, tin, antimony, tellurium, lead, bismuth, a transition metal and combinations thereof; and, (ii) a photothermal conversion material;

wherein the ink repellent layer contains less than 5% hydrocarbon groups by weight.

2. The element of claim 1 wherein said support web is a polyester film.

3. The element of claim 1 wherein the support web is an anodized aluminum sheet.

4. The element of claim 1 wherein the photothermal conversion layer comprises carbon dispersed in a cellulosic binder.

5. The element of claim 1 wherein the photothermal conversion layer comprises carbon dispersed in nitrocellulose.

6. The element of claim 1 wherein the photothermal conversion layer comprises carbon dispersed in a polyvinylbutyral.

7. The element of claim 6 wherein the polyvinylbutyral is poly(vinylbutyral-co-vinylalcohol-co-vinylacetate)(80%, 18%,2%).

8. The element of claim 1 wherein the photothermal conversion layer comprises an IR dye dispersed in a cellulosic binder.

9. The element of claim 8 wherein the IR dye is 2-{2-{2-Chloro-3-{(1,3-dihydro-1,1,3-trimethyl-2H-benz {e}indol-2-ylidene)ethylidene}-1-cyclohexen-1-yl}-ethenyl}-1,1,3-trimethyl-1H-benz{e}indolium salt of 4-methylbenzenesufonate; or 2-{2-{2-chloro-3-{(1,3-dihydro-1,1-dimethyl-3-sulfonatopropyl-2H-benz {e}indol-2-ylidene)ethylidene}-1-cylcohexen-1-yl}ethenyl}-1,1-dimethyl-3-sulfonatopropyl-1H-benz {e}indolium sodium salt.

10. The element of claim 1 wherein the photothermal conversion layer comprises an evaporated layer of titanium.

11. The element of claim 1 wherein the ink repellent layer is a hydrophilic layer.

12. The element of claim 1 wherein the thickness of the ink repellent layer is from 0.05 to 1 $\mu$m.

13. The element of claim 1 wherein the thickness of the ink repellent layer is from 0.1 to 0.3 $\mu$m.

14. The element of claim 1 wherein the colloid is hydroxysilicon.

15. The element of claim 1 wherein the colloid is hydroxyaluminum.

16. The element of claim 1 wherein the colloid is hydroxytitanium.

17. The element of claim 1 wherein the colloid is hydroxyzirconium.

18. The element of claim 1 wherein the photothermal conversion material is carbon.

19. The element of claim 18 wherein the carbon is sulfonic acid surface modified submicron carbon particles.

20. The element of claim 1 wherein the photothermal conversion material is an IR dye.

21. The element of claim 20 wherein the IR dye is 2-{2-{2-Chloro-3-{(1,3-dihydro-1,1,3-trimethyl-2H-benz{e}indol-2-ylidene)ethylidene}-1-cyclohexen-1-yl}-ethenyl}-1,1,3-trimethyl-1H-benz{e}indolium salt of 4-methylbenzenesufonate; or 2-{2-{2-Chloro-3-{(1,3-dihydro-1,1,3-trimethyl-2H-benz{e}indol-2-ylidene) ethylidene}-1-cyclohexen-1-yl}-ethenyl}-1,1,3-trimethyl-1H-benz{e}indolium salt of 4-methylbenzenesufonate.

22. The element of claim 1 wherein the crosslinked polymeric matrix is derived from a crosslinking agent which is an alkoxy silane, an alkyl titanate, an alkyl zirconate or an alkyl aluminate.

23. The element of claim 22 wherein the crosslinking agent is a di, tri, or tetra alkoxy silane.

24. The element of claim 22 wherein the crosslinking agent is aminopropyltriethoxysilane.

25. The element of claim 22 wherein the crosslinking agent is a mixture of di methyldimethoxysilane and methyltrimethoxysilane.

26. The element of claim 22 wherein the crosslinking agent is glycidoxypropyltrimethoxysilane.

27. The element of claim 22 wherein the crosslinking agent is tetraethylorthosilicate.

28. The element of claim 22 wherein the crosslinking agent is tetrabutyltitanate.

29. The element of claim 22 wherein the crosslinking agent is zirconium butoxide.

30. The element of claim 22 wherein the coextensive ink repellant layer contains 100 to 5000% of the colloid based on the weight of the crosslinking agent.

31. A method of making a lithographic printing plate comprising:

I) providing an element comprising:

a) a support web;

b) a coextensive ink receptive photothermal conversion layer; and, c) a coextensive ink repellent layer comprising:

(i) a crosslinked polymeric matrix containing a colloid of an oxide or a hydroxide of a metal selected from the group consisting of beryllium, magnesium, aluminum, silicon, gadolinium, germanium, arsenic, indium, tin, antimony, tellurium, lead, bismuth, a transition metal and combinations thereof; and, (ii) a photothermal conversion materials;

wherein the ink repellent layer contains less than 5% hydrocarbon groups by weight; and, II) exposing the element to a laser beam having an intensity greater than 0.1 mW/$\square^2$ for a time sufficient to give a total exposure of 200 mJ/cm$^2$ or greater to form an exposed lithographic printing plate.

32. The method of claim 31 wherein after exposing the element to the laser beam, the exposed lithographic printing plate is directly mounted on a lithographic printing press.

* * * * *